US007859501B2

(12) United States Patent
Levey et al.

(10) Patent No.: US 7,859,501 B2
(45) Date of Patent: Dec. 28, 2010

(54) OLED DISPLAY WITH AGING AND EFFICIENCY COMPENSATION

(75) Inventors: Charles I. Levey, West Henrietta, NY (US); Gary Parrett, Rochester, NY (US)

(73) Assignee: Global OLED Technology LLC, Herndon, VA (US)

( * ) Notice: Subject to any disclaimer, the term of this patent is extended or adjusted under 35 U.S.C. 154(b) by 858 days.

(21) Appl. No.: 11/766,823

(22) Filed: Jun. 22, 2007

(65) Prior Publication Data

US 2008/0315788 A1 Dec. 25, 2008

(51) Int. Cl.
*G09G 3/36* (2006.01)

(52) U.S. Cl. ..... 345/90; 313/484

(58) Field of Classification Search ..... 345/87–90; 315/484

See application file for complete search history.

(56) References Cited

U.S. PATENT DOCUMENTS

| | | | | |
|---|---|---|---|---|
| 6,414,661 | B1 | 7/2002 | Shen et al. | |
| 6,456,016 | B1 | 9/2002 | Sundahl et al. | |
| 6,504,565 | B1 | 1/2003 | Narita et al. | |
| 6,995,519 | B2 | 2/2006 | Arnold et al. | |
| 7,391,335 | B2 * | 6/2008 | Mubaslat et al. | 340/657 |
| 2002/0167474 | A1 | 11/2002 | Everitt | |
| 2003/0122813 | A1 | 7/2003 | Ishizuki et al. | |
| 2004/0100430 | A1 | 5/2004 | Fruehauf | |
| 2006/0158402 | A1 * | 7/2006 | Nathan et al. | 345/82 |
| 2007/0195020 | A1 | 8/2007 | Nathan et al. | |

FOREIGN PATENT DOCUMENTS

| | | |
|---|---|---|
| JP | 2002-278514 | 9/2002 |
| WO | 2005/022498 | 3/2005 |
| WO | 2005/109389 | 11/2005 |
| WO | 2006/063448 | 6/2006 |

OTHER PUBLICATIONS

"P-12: A New a-Si:H TFT Pixel Design Compensating Threshold Voltage Degradation of TFT and OLED" by Jae-Hoon Lee et al., SID International Symposium, May 25-27, 2004, pp. 264-267 XP-007012052.

* cited by examiner

*Primary Examiner*—Amare Mengistu
*Assistant Examiner*—Vinh Lam
(74) *Attorney, Agent, or Firm*—Morgan Lewis & Bockius LLP

(57) ABSTRACT

A method of compensating for changes in an OLED drive circuit, includes: providing a drive transistor; providing a first voltage source and a first switch; providing an OLED device connected to the drive transistor. Voltages are measured and used to compensate for changes in the OLED drive transistor.

9 Claims, 6 Drawing Sheets

OLED DISPLAY WITH AGING AND EFFICIENCY COMPENSATION

FIELD OF THE INVENTION

The present invention relates to solid-state OLED flat-panel displays and more particularly to such displays having ways to compensate for the aging of the organic light emitting display components.

BACKGROUND OF THE INVENTION

Solid-state organic light-emitting diode (OLED) displays are of great interest as a superior flat-panel display technology. These displays utilize current passing through thin films of organic material to generate light. The color of light emitted and the efficiency of the energy conversion from current to light are determined by the composition of the organic thin-film material. Different organic materials emit different colors of light. However, as the display is used, the organic materials in the display age and become less efficient at emitting light. This reduces the lifetime of the display. The differing organic materials can age at different rates, causing differential color aging and a display whose white point varies as the display is used. In addition, each individual pixel can age at a rate different from other pixels, resulting in display nonuniformity. Further, some circuitry elements, e.g. amorphous silicon transistors, are also known to exhibit aging effects.

The rate at which the materials age is related to the amount of current that passes through the display and, hence, the amount of light that has been emitted from the display. One technique to compensate for this aging effect in polymer light-emitting diodes is described in U.S. Pat. No. 6,456,016 by Sundahl et al. This approach relies on a controlled reduction of current provided at an early stage of use followed by a second stage in which the display output is gradually decreased. This solution requires that a timer within the controller, which then provides a compensating amount of current, track the operating time of the display. Moreover, once a display has been in use, the controller must remain associated with that display to avoid errors in display operating time. This technique has the disadvantage of not representing the performance of small-molecule organic light emitting diode displays well. Moreover, the time the display has been in use must be accumulated, requiring timing, calculation, and storage circuitry in the controller. Also, this technique does not accommodate differences in behavior of the display at varying levels of brightness and temperature and cannot accommodate differential aging rates of the different organic materials.

U.S. Pat. No. 6,414,661 B1 by Shen et al. describes a method and associated system to compensate for long-term variations in the light-emitting efficiency of individual organic light-emitting diodes (OLEDs) in an OLED display by calculating and predicting the decay in light output efficiency of each pixel based on the accumulated drive current applied to the pixel. The method derives a correction coefficient that is applied to the next drive current for each pixel. This technique requires the measurement and accumulation of drive current applied to each pixel, requiring a stored memory that must be continuously updated as the display is used, and therefore requiring complex and extensive circuitry.

U.S. Patent Application 2002/0167474 A1 by Everitt describes a pulse width modulation driver for an OLED display. One embodiment of a video display comprises a voltage driver for providing a selected voltage to drive an organic light-emitting diode in a video display. The voltage driver can receive voltage information from a correction table that accounts for aging, column resistance, row resistance, and other diode characteristics. In one embodiment of the invention, the correction tables are calculated prior to or during normal circuit operation. Since the OLED output light level is assumed to be linear with respect to OLED current, the correction scheme is based on sending a known current through the OLED diode for a duration sufficiently long to allow the transients to settle out, and then measuring the corresponding voltage with an analog-to-digital converter (A/D) residing on the column driver. A calibration current source and the A/D can be switched to any column through a switching matrix.

U.S. Pat. No. 6,504,565 B1 by Narita et al. describes a light-emitting display which includes a light-emitting element array formed by arranging a plurality of light-emitting elements, a driving unit for driving the light-emitting element array to emit light from each of the light-emitting elements, a memory unit for storing the number of light emissions for each light-emitting element of the light-emitting element array, and a control unit for controlling the driving unit based on the information stored in the memory unit so that the amount of light emitted from each light-emitting element is held constant. An exposure display employing the light-emitting display, and an image-forming apparatus employing the exposure display are also disclosed. This design requires the use of a calculation unit responsive to each signal sent to each pixel to record usage, greatly increasing the complexity of the circuit design.

JP 2002278514 A by Numeo Koji describes a method in which a prescribed voltage is applied to organic EL elements by a current-measuring circuit, the current flows are measured, and a temperature measurement circuit estimates the temperature of the organic EL elements. A comparison is made with the voltage value applied to the elements, the flow of current values and the estimated temperature, the changes due to aging of similarly constituted elements determined beforehand, the changes due to aging in the current-luminance characteristics, and the temperature at the time of the characteristics measurements for estimating the current-luminance characteristics of the elements. Then, the total sum of the amount of currents being supplied to the elements in the interval during which display data are displayed is changed, which can provide the luminance that is to be originally displayed, based on the estimated values of the current-luminance characteristics, the values of the current flowing in the elements, and the display data. This design presumes a predictable relative use of pixels and does not accommodate differences in actual usage of groups of pixels or of individual pixels. Hence, correction for color or spatial groups is likely to be inaccurate over time. Moreover, the integration of temperature and multiple current sensing circuits within the display is required. This integration is complex, reduces manufacturing yields, and takes up space within the display.

U.S. Patent Application 2003/0122813 A1 by Ishizuki et al. discloses a display panel driving device and driving method for providing high-quality images without irregular luminance even after long-time use. The light-emission drive current flowing is measured while each pixel successively and independently emits light. Then the luminance is corrected for each input pixel data based on the measured drive current values. According to another aspect, the drive voltage is adjusted such that one drive current value becomes equal to a predetermined reference current. In a further aspect, the current is measured while an off-set current, corresponding to a leak current of the display panel, is added to the current output from the drive voltage generator circuit, and the resultant current is supplied to each of the pixel portions. The measurement techniques are iterative, and therefore slow.

Arnold et al., in U.S. Pat. No. 6,995,519, teach a method of compensating for aging of an OLED device. This method assumes that the entire change in device luminance is caused by changes in the OLED emitter. However, when the drive transistors in the circuit are formed from amorphous silicon (a-Si), this assumption is not valid, as the threshold voltage of the transistors also changes with use. The method of Arnold will not provide complete compensation for OLED efficiency losses in circuits wherein transistors show aging effects. Additionally, when methods such as reverse bias are used to mitigate a-Si transistor threshold voltage shifts, compensation of OLED efficiency loss can become unreliable without appropriate tracking/prediction of reverse bias effects, or a direct measurement of the OLED voltage change or transistor threshold voltage change.

There is a need therefore for a more complete compensation approach for organic light emitting diode displays.

SUMMARY OF THE INVENTION

It is therefore an object of the present invention to compensate for aging and efficiency changes in OLED emitters in the presence of transistor aging.

This object is achieved by a method of compensating for changes in characteristics of an OLED drive circuit, comprising:

a. providing a drive transistor with a first electrode, a second electrode, and a gate electrode;

b. providing a first voltage source and a first switch for selectively connecting the first voltage source to the first electrode of the drive transistor;

c. providing an OLED device connected to the second electrode of the drive transistor, and a second voltage source and a second switch for selectively connecting the OLED device to the second voltage source;

d. connecting the first electrode of a readout transistor to the second electrode of the drive transistor;

e. providing a current source and a third switch for selectively connecting the current source to the second electrode of the readout transistor;

f. providing a current sink and a fourth switch for selectively connecting the current sink to the second electrode of the readout transistor;

g. providing a test voltage to the gate electrode of the drive transistor and providing a voltage measurement circuit connected to the second electrode of the readout transistor;

h. closing the first and fourth switches, and opening the second and third switches and using the voltage measurement circuit to measure the voltage at the second electrode of the readout transistor to provide a first signal representative of characteristics of the drive transistor;

i. opening the first and fourth switches, and closing the second and third switches and using the voltage measurement circuit to measure the voltage at the second electrode of the readout transistor to provide a second signal representative of characteristics of the OLED device; and j. using the first and second signals to compensate for changes in characteristics of the OLED drive circuit.

ADVANTAGES

An advantage of this invention is an OLED display that compensates for the aging of the organic materials in the display wherein circuitry aging is also occurring, without requiring extensive or complex circuitry for accumulating a continuous measurement of light-emitting element use or time of operation. It is a further advantage of this invention that it uses simple voltage measurement circuitry. It is a further advantage of this invention that by making all measurements of voltage, it is more sensitive to changes than methods that measure current. It is a further advantage of this invention that it performs the compensation based on OLED changes, without being confounded with changes in driving transistor properties. It is a further advantage of this invention that compensation for changes in driving transistor properties can be performed with compensation for the OLED changes, thus providing a complete compensation solution. It is a further advantage of this invention that both aspects of measurement and compensation (OLED and driving transistor) can be accomplished rapidly. It is a further advantage of this invention that a single select line can be used to enable data input and data readout. It is a further advantage of this invention that characterization and compensation of driving transistor and OLED changes are unique to the specific element and are not impacted by other elements that may be open-circuited or short-circuited.

DETAILED DESCRIPTION OF THE INVENTION

Figure 1:
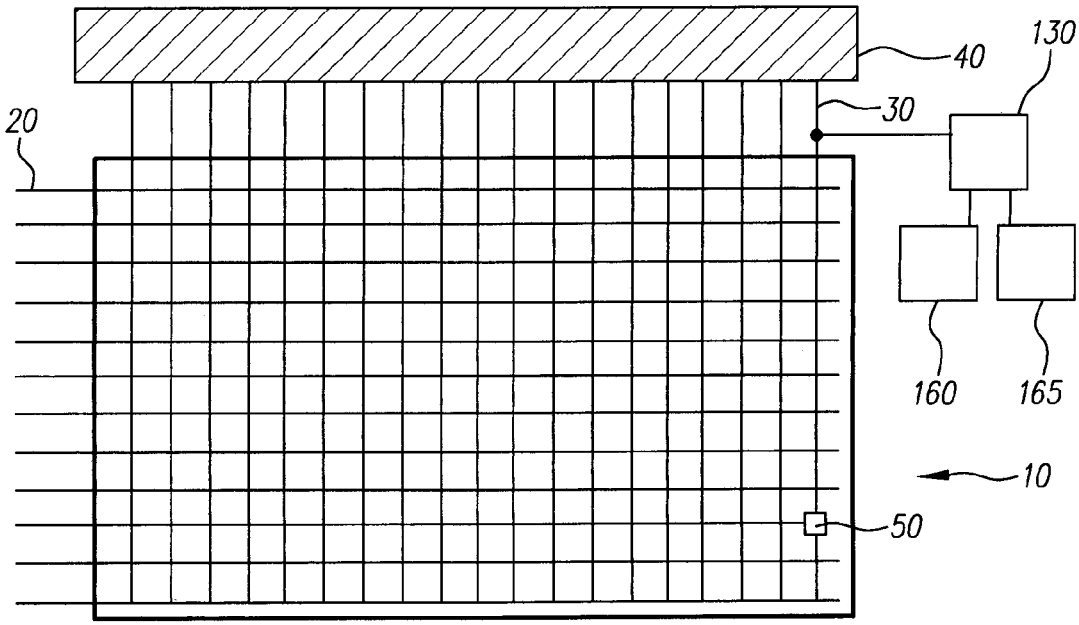
FIG. 1 is a schematic diagram of one embodiment of an OLED display that can be used in the practice of the present invention.

Turning now to FIG. 1, there is shown a schematic diagram of one embodiment of an OLED display that can be used in the practice of the present invention. OLED display 10 comprises an array of a predetermined number of OLED devices 50 arranged in rows and columns, wherein each OLED device 50 is a pixel of OLED display 10. Each OLED device is associated with a corresponding OLED drive circuit whose nature will become apparent. OLED display 10 includes a plurality of row select lines 20 wherein each row of OLED devices 50 has a select line 20. OLED display 10 includes a plurality of readout lines 30 wherein each column of OLED devices 50 has a readout line 30. Each readout line 30 is connected to a switch block 130, which connects readout line 30 to either current source 160 or current sink 165 during the calibration process. Although not shown for clarity of illustration, each column of OLED devices 50 also has a data line as well-known in the art. The plurality of readout lines 30 is connected to one or more multiplexers 40, which permits parallel/sequential readout of signals from OLED drive circuits, as will become apparent. Multiplexer 40 can be a part of the same structure as OLED display 10, or can be a separate construction that can be connected to or disconnected from OLED display 10.

Figure 2:
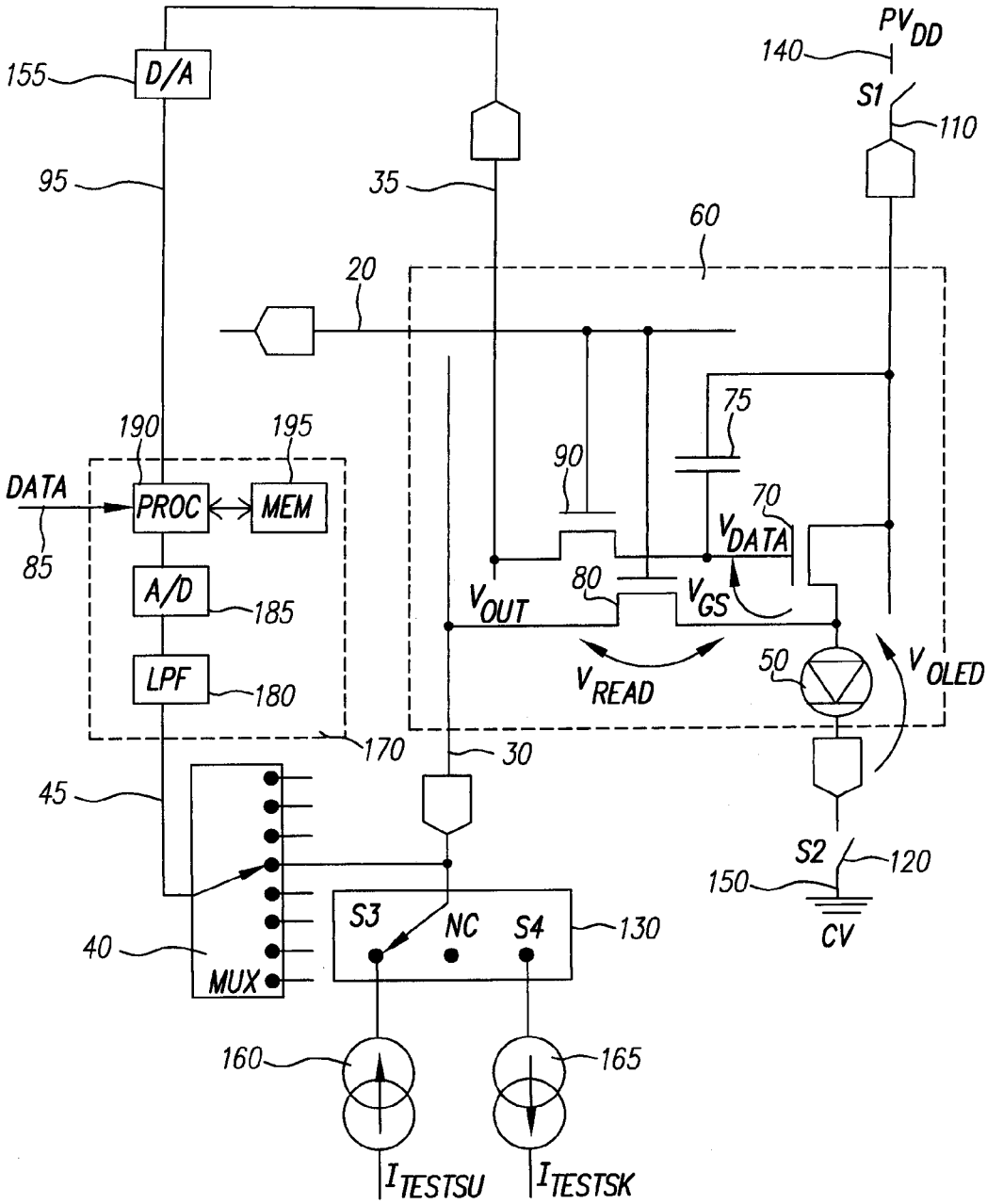
FIG. 2 is a schematic diagram of one embodiment of an OLED drive circuit that can be used in the practice of the present invention.

Turning now to FIG. 2, there is shown a schematic diagram of one embodiment of an OLED drive circuit that can be used in the practice of the present invention. OLED drive circuit 60 includes OLED device 50, drive transistor 70, capacitor 75, readout transistor 80, and select transistor 90. Each of the transistors has a first electrode, a second electrode, and a gate electrode. A first voltage source 140 can be selectively connected to the first electrode of drive transistor 70 by first switch 110, which can be located on the OLED display substrate or on a separate structure. By connected, it is meant that the elements are directly connected or connected via another component, e.g. a switch, a diode, or another transistor. The second electrode of drive transistor 70 is connected to OLED device 50, and a second voltage source 150 can be selectively connected to OLED device 50 by second switch 120, which can also be off the OLED display substrate. At least one first switch 110 and second switch 120 are provided for the OLED display. Additional first and second switches can be provided if the OLED display has multiple powered subgroupings of pixels. In normal display mode, the first and second switches are closed, while other switches (described below) are open. The gate electrode of drive transistor 70 is connected to select transistor 90 to selectively provide data from data line 35 to drive transistor 70 as well known in the art. The row select line 20 is connected to the gate electrodes of the select transistors 90 in the row of OLED drive circuits 60. The gate electrode of select transistor 90 is connected to the gate electrode of readout transistor 80.

The first electrode of readout transistor 80 is connected to the second electrode of drive transistor 70 and to OLED device 50. The readout line 30 is connected to the second electrodes of the readout transistors 80 in a column of pixel circuits 60. Readout line 30 is connected to switch block 130. One switch block 130 is provided for each column of OLED drive circuits 60. Switch block 130 includes a third switch S3 and a fourth switch S4, and a No-Connect state NC. While the third and fourth switches can be individual entities, they are never closed simultaneously in this method, and thus switch block 130 provides a convenient embodiment of the two switches. The third switch allows current source 160 to be selectively connected to the second electrode of readout transistor 80. Current source 160, when connected by the third switch, allows a predetermined constant current to flow into OLED drive circuit 60. The fourth switch allows current sink 165 to be selectively connected to the second electrode of readout transistor 80. Current sink 165, when connected by the fourth switch, allows a predetermined constant current to flow from OLED drive circuit 60 when a predetermined data value is applied to data line 35. Switch block 130, current source 160, and current sink 165 can be provided located on or off the OLED display substrate.

The second electrode of readout transistor 80 is also connected to voltage measurement circuit 170, which measures voltages to provide signals representative of characteristics of OLED drive circuit 60. Voltage measurement circuit 170 comprises at least analog-to-digital converter 185 for converting voltage measurements into digital signals, and processor 190. The signal from analog-to-digital converter 185 is sent to processor 190. Voltage measurement circuit 170 can also include memory 195 for storing voltage measurements, and a low-pass filter 180 if necessary. Voltage measurement circuit 170 can be connected through readout line 45 and multiplexer 40 to a plurality of readout lines 30 and readout transistors 80 for sequentially reading out the voltages from a predetermined number of OLED drive circuits 60. If there are a plurality of multiplexers 40, each can have its own readout line 45. Thus, a predetermined number of OLED drive circuits can be driven simultaneously. The plurality of multiplexers will allow parallel reading out of the voltages from the various multiplexers 40, while each multiplexer would allow sequential reading out of the readout lines 30 attached to it. This will be referred to herein as a parallel/sequential process.

Processor 190 can also be connected to data line 35 by way of control line 95 and digital-to-analog converter 155. Thus, processor 190 can provide predetermined data values to data line 35 during the measurement process to be described herein. Processor 190 can also accept display data via data in 85 and provide compensation for changes as will be described herein, thus providing compensated data to data line 35 during the display process.

Transistors such as drive transistor 70 of OLED drive circuit 60 have a characteristic threshold voltage ($V_{th}$). The voltage on the gate electrode of drive transistor 70 must be greater than the threshold voltage to enable current flow between the first and second electrodes. When drive transistor 70 is an amorphous silicon transistor, the threshold voltage is known to change under aging conditions. Such conditions include placing drive transistor 70 under actual usage conditions, thereby leading to an increase in the threshold voltage. Therefore, a constant signal on the gate electrode will cause a gradually decreasing light intensity emitted by OLED device 50. The amount of such decrease will depend upon the use of drive transistor 70; thus, the decrease can be different for different drive transistors in a display, herein termed spatial variations in characteristics of OLED drive circuits 60. Such spatial variations can include differences in brightness and color balance in different parts of the display, and image "burn-in" wherein an often-displayed image (e.g. a network logo) can cause a ghost of itself to always show on the active display. It is desirable to compensate for such changes in the threshold voltage to prevent such problems. Also, there can be age-related changes to OLED device 50, e.g. luminance efficiency loss and an increase in resistance across OLED device 50.

Figure 3A:
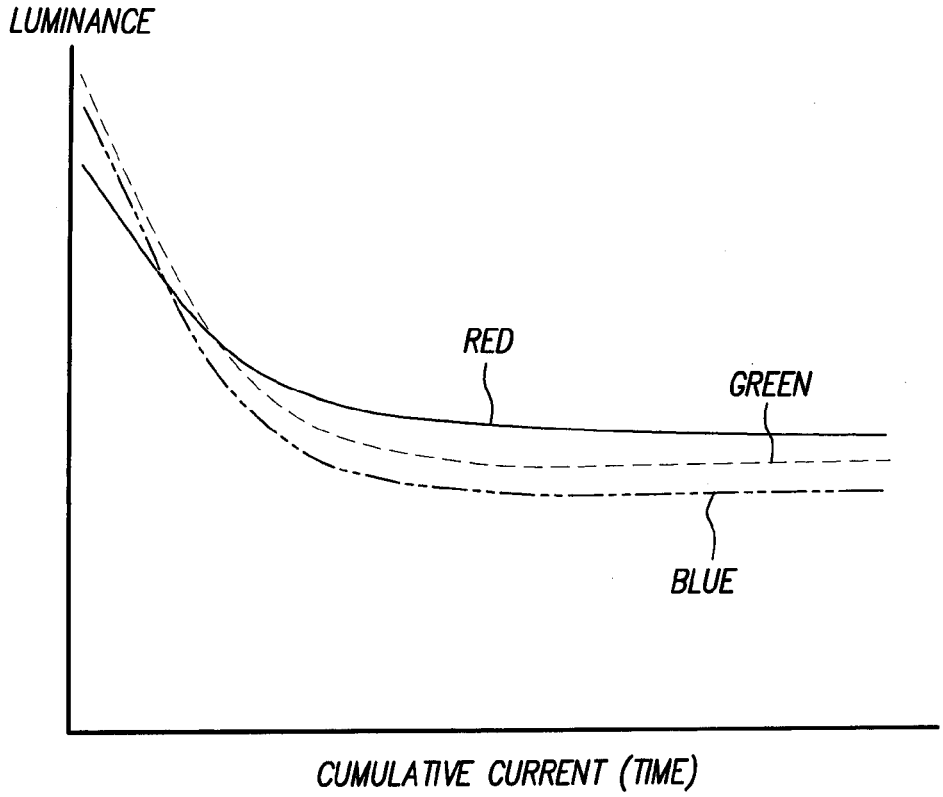
FIG. 3A is a diagram illustrating the effect of aging of an OLED device on luminance efficiency.

Turning now to FIG. 3A, there is shown a diagram illustrating the effect of aging of an OLED device on luminance efficiency as current is passed through the OLED devices. The three curves represent typical performance of different light emitters emitting differently colored light (e.g. R,G,B representing red, green and blue light emitters, respectively) as represented by luminance output over time or cumulative current. The decay in luminance between the differently colored light emitters can be different. The differences can be due to different aging characteristics of materials used in the differently colored light emitters, or due to different usages of the differently colored light emitters. Hence, in conventional use, with no aging correction, the display can become less bright and the color of the display—in particular the white point—can shift.

Figure 3B:
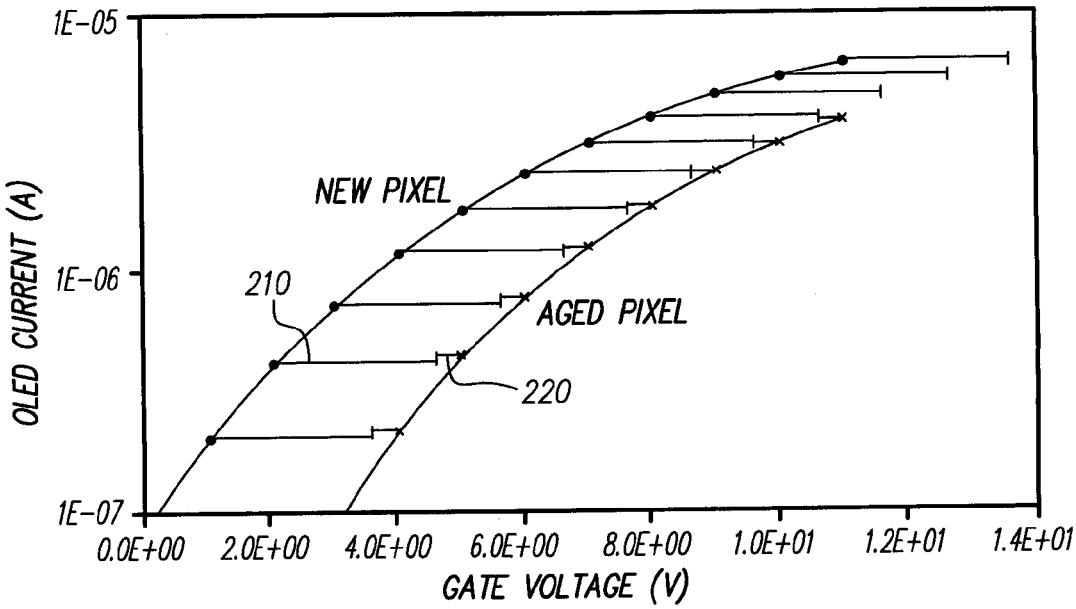
FIG. 3B is a diagram illustrating the effect of aging of an OLED device or a drive transistor on device current.

Turning now to FIG. 3B, there is shown a diagram illustrating the effect of aging of an OLED device or a drive transistor, or both, on device current. In describing OLED drive circuit change, the horizontal axis of FIG. 3B represents the gate voltage at drive transistor 70. As the circuit ages, a greater voltage is required to obtain a desired current; that is, the curve moves by an amount $\Delta V$. $\Delta V$ is the sum of the change in threshold voltage ($\Delta V_{th}$, 210) and the change in OLED voltage resulting from a change in OLED device resistance ($\Delta V_{OLED}$, 220), as shown. This change results in reduced performance. A greater gate voltage is required to obtain a desired current. The relationship between the OLED current (which is also the drain-source current through the drive transistor), OLED voltage, and threshold voltage at saturation is:

$$I_{oled} = \frac{W\bar{\mu}C_0}{2L}(V_{gs} - V_{th})^2 = \frac{K}{2}(V_g - V_{oled} - V_{th})^2 \quad \text{(Eq. 1)}$$

where W is the TFT Channel Width, L is the TFT Channel Length, μ is the TFT mobility, $C_0$ is the Oxide Capacitance per Unit Area, $V_g$ is the gate voltage, $V_{gs}$ is voltage difference between gate and source of the drive transistor. For simplicity, we neglect dependence of μ on $V_{gs}$. Thus, to keep the current constant, one must correct for change in $V_{th}$ and $V_{OLED}$. It is therefore desirable to measure both changes.

Figure 4:
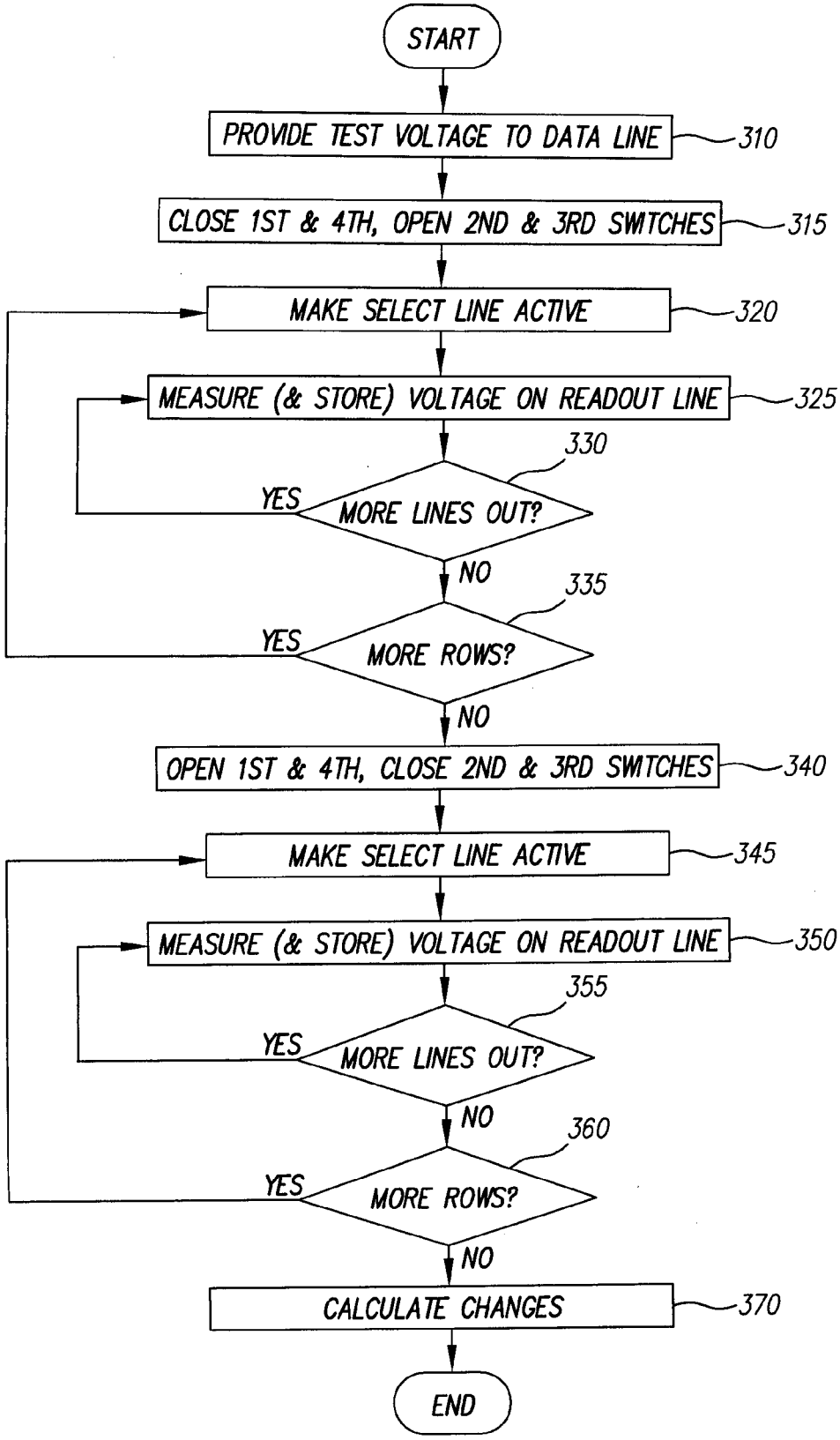
FIG. 4 is a block diagram of one embodiment of the method of the present invention.

Turning now to FIG. 4, and referring also to FIG. 2, there is shown a block diagram of one embodiment of the method of the present invention. A predetermined test voltage ($V_{data}$) is provided to data line 35 (Step 310). First switch 110 is closed and second switch 120 is opened. The fourth switch is closed and the third switch is opened, that is, switch block 130 is switched to S4 (Step 315). Select line 20 is made active for a selected row to provide the test voltage to the gate electrode of drive transistor 70 and to turn on readout transistor 80 (Step 320). A current thus flows from first voltage source 140 through drive transistor 70 to current sink 165. The value of current ($I_{testsk}$) through current sink 165 is selected to be less than the resulting current through drive transistor 70 due to the application of $V_{data}$; a typical value will be in the range of 1 to 5 microamps and will be constant for all measurements during the lifetime of the OLED drive circuit. The selected value of $V_{data}$ is constant for all such measurements during the lifetime of the circuit, and therefore must be sufficient to provide a current through drive-transistor 70 greater than that at current sink 165 even after aging expected during the lifetime of the display. Thus, the limiting value of current through drive transistor 70 will be controlled entirely by current sink 165, which will be the same as through drive transistor 70. The value of $V_{data}$ can be selected based upon known or determined current-voltage and aging characteristics of drive transistor 70. More than one measurement value can be used in this process, e.g. one can choose to do the measurement at 1, 2, and 3 microamps using a value of $V_{data}$ that is sufficient to remain constant for the largest current during the lifetime of the OLED drive circuit. Voltage measurement circuit 170 is used to measure the voltage on readout line 30, which is the voltage $V_{out}$ at the second electrode of readout transistor 80, providing a first signal $V_1$ that is representative of characteristics of drive transistor 70 (Step 325), including the threshold voltage $V_{th}$ of drive transistor 70. If the OLED display incorporates a plurality of OLED drive circuits and there are additional OLED drive circuits in the row to be measured, multiplexer 40 connected to a plurality of readout lines 30 can be used to allow voltage measurement circuit 170 to sequentially read out the first signals $V_1$ from a predetermined number of OLED drive circuits, e.g. every circuit in the row (Step 330). If the display is sufficiently large, it can require a plurality of multiplexers wherein the first signal can be provided in a parallel/sequential process. If there are additional rows of circuits to be measured (Step 335), a different row is selected by a different select line and the measurements are repeated. The voltages of the components in the circuit can be related by:

$$V_1 = V_{data} - V_{gs(Itestsk)} - V_{read} \quad \text{(Eq. 2)}$$

where $V_{gs(Itestsk)}$ is the gate-to-source voltage that must be applied to drive transistor 70 such that it's drain-to-source current, $I_{ds}$, is equal to $I_{testsk}$.

The values of these voltages will cause the voltage at the second electrode of readout transistor 80 ($V_{out}$) to adjust to fulfill Eq. 2. Under the conditions described above, $V_{data}$ is a set value and $V_{read}$ can be assumed to be constant. $V_{gs}$ will be controlled by the value of the current set by current sink 165 and the current-voltage characteristics of drive transistor 70, and will change with age-related changes in the threshold voltage of the drive transistor. To determine the change in the threshold voltage of drive transistor 70, two separate test measurements are performed. The first measurement is performed when drive transistor 70 is not degraded by aging, e.g. before OLED drive circuit 60 is used for display purposes, to cause the voltage $V_1$ to be at a first level, which is measured and stored. Since this is with zero aging, it can be the ideal first signal value, and will be termed the first target signal. After drive transistor 70 has aged, e.g. by displaying images for a predetermined time, the measurement is repeated and stored. The stored results can be compared. Changes to the threshold voltage of drive transistor 70 will cause a change to $V_{gs}$ to maintain the current. These changes will be reflected in changes to $V_1$ in Eq. 2, so as to produce voltage $V_1$ at a second level, which can be measured and stored. Changes in the corresponding stored signals can be compared to calculate a change in the readout voltage $V_1$, which is related to the changes in drive transistor 70 as follows:

$$\Delta V_1 = -\Delta V_{gs} = -\Delta V_{th} \quad \text{(Eq. 3)}$$

The above method requires that a first level for $V_1$ for each drive circuit be stored in memory for later comparison. A less memory-intensive method can be used that does not require an initial measurement, but can compensate for spatial variations in the threshold voltage. After aging, the value of $V_1$ can be recorded for each drive circuit with selected values for current sink 165, as previously described. Then, the drive circuit with the minimum $V_{th}$ shift (that is, the maximum measured $V_1$) is selected as the first target signal, $V_{1target}$, from the population of drive circuits measured. The differences in the threshold voltages of the other drive circuits can be expressed as:

$$\Delta V_1 = -\Delta V_{th} = V_1 - V_{1target} \quad \text{(Eq. 4)}$$

First switch 110 is then opened and second switch 120 is closed. Switch block 130 is switched to S3, thereby opening the fourth switch and closing the third switch (Step 340). Select line 20 is made active for a selected row to turn on readout transistor 70 (Step 345). A current, $I_{testsu}$, thus flows from current source 160 through OLED device 50 to second voltage source 150. The value of current through current source 160 is selected to be less than the maximum current possible through OLED device 50; a typical value will be in the range of 1 to 5 microamps and will be constant for all measurements during the lifetime of the OLED drive circuit. More than one measurement value can be used in this process, e.g. one can choose to do the measurement at 1, 2, and 3 microamps. Voltage measurement circuit 170 is used to measure the voltage on readout line 30, which is the voltage $V_{out}$ at the second electrode of readout transistor 80, providing a second signal $V_2$ that is representative of characteristics of OLED device 50, including the resistance of OLED device 50 (Step 350). If there are additional OLED drive circuits in the row to be measured, multiplexer 40 connected to a plurality of readout lines 30 can be used to allow voltage measurement circuit 170 to sequentially read out the second signal $V_2$ for a predetermined number of OLED drive circuits, e.g. every circuit in the row (Step 355). If the display is sufficiently large, it can require a plurality of multiplexers wherein the second signal can be provided in a parallel/sequential process. If there are additional rows of circuits to be measured in OLED display 10. Steps 345 to 355 are repeated for each row (Step 360). The voltages of the components in the circuit can be related by:

$$V_2=CV+V_{OLED}+V_{read} \quad \text{(Eq. 5)}$$

The values of these voltages will cause the voltage at the second electrode of readout transistor 80 ($V_{out}$) to adjust to fulfill Eq. 5. Under the conditions described above, CV is a set value and $V_{read}$ can be assumed to be constant. $V_{OLED}$ will be controlled by the value of current set by current source 160 and the current-voltage characteristics of OLED device 50. $V_{OLED}$ can change with age-related changes in OLED device 50. To determine the change in $V_{OLED}$, two separate test measurements are performed. The first measurement is performed when OLED device 50 is not degraded by aging, e.g. before OLED drive circuit 60 is used for display purposes, to cause the voltage $V_2$ to be at a first level, which is measured and stored. Since this is with zero aging, it can be the ideal second signal value, and will be termed the second target signal. After OLED device 50 has aged, e.g. by displaying images for a predetermined time, the measurement is repeated and stored. The stored results can be compared. Changes in OLED device 50 can cause changes to $V_{OLED}$ to maintain the current. These changes will be reflected in changes to $V_2$ in Eq. 4, so as to produce voltage $V_2$ at a second level, which can be measured and stored. Changes in the corresponding stored signals can be compared to calculate a change in the readout voltage, which is related to the changes in OLED device 50 as follows:

$$\Delta V_2=\Delta V_{OLED} \quad \text{(Eq. 6)}$$

The above method requires that a first level for $V_2$ for each drive circuit be stored in memory for later comparison. A less memory-intensive method can be used that does not require an initial measurement, but can compensate for spatial variations in $V_{OLED}$. After aging, the value of $V_2$ can be recorded for each drive circuit with selected values for current source 160, as previously described. Then, the drive circuit with the minimum $V_{OLED}$ shift (that is, the minimum measured $V_2$) is selected as the second target signal, $V_{2target}$, from the population of drive circuits measured. The differences in the threshold voltages of the other drive circuits can be expressed as:

$$\Delta V_2=\Delta V_{OLED}=V_2-V_{2target} \quad \text{(Eq. 7)}$$

The changes in the first and second signals can then be used to compensate for changes in characteristics of OLED drive circuit 60 (Step 370). For compensating for the change in current, it is necessary to make a correction for $\Delta V_{th}$ (related to $\Delta V_1$) and $\Delta V_{OLED}$ (related to $\Delta V_2$). However, a third factor also affects the luminance of the OLED device and change with age or use: the efficiency of the OLED device decreases, which decreases the light emitted at a given current (shown in FIG. 3A). In addition to the relations above, a relationship has been found between the decrease in luminance efficiency of an OLED device and $\Delta V_{OLED}$, that is, where the OLED luminance for a given current is a function of the change in $V_{OLED}$:

$$\frac{L_{OLED}}{I_{OLED}} = f(\Delta V_{OLED}) \quad \text{(Eq. 8)}$$

Figure 5:
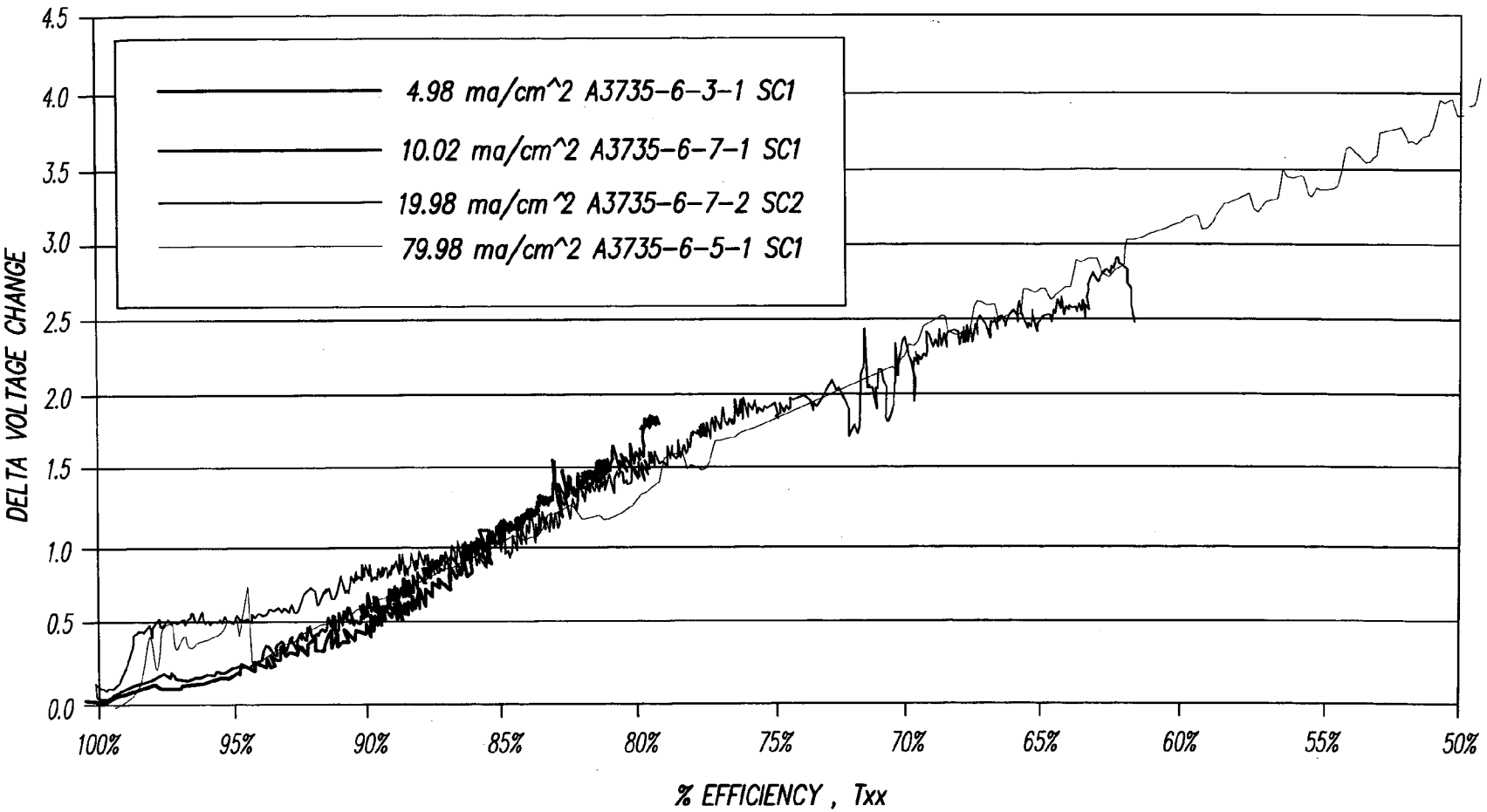
FIG. 5 is a graph showing the relationship between OLED efficiency and the change in OLED voltage.

An example of the relationship between luminance efficiency and $\Delta V_{OLED}$ for one device is shown in the graph in FIG. 5. By measuring the luminance decrease and its relationship to $\Delta V_{OLED}$ with a given current, a change in corrected signal necessary to cause the OLED device 50 to output a nominal luminance can be determined. This measurement can be done on a model system and thereafter stored in a lookup table or used as an algorithm.

To compensate for the above changes in characteristics of OLED drive circuit 60, one can use the changes in the first and second signals in an equation of the form:

$$\Delta V_{data}=f_1(\Delta V_1)+f_2(\Delta V_2)+f_3(\Delta V_2) \quad \text{(Eq. 9)}$$

where $\Delta V_{data}$ is an offset voltage on the gate electrode of drive transistor 70 necessary to maintain the desired luminance, $f_1(\Delta V_1)$ is a correction for the change in threshold voltage, $f_2(\Delta V_2)$ is a correction for the change in OLED resistance, and $f_3(\Delta V_2)$ is a correction for the change in OLED efficiency. For example, the OLED display can include a controller, which can include a lookup table or algorithm to compute an offset voltage for each OLED device. The offset voltage is computed to provide corrections for changes in current due to changes in the threshold voltage of drive transistor 70 and aging of OLED device 50, as well as providing a current increase to compensate for efficiency loss due to aging of OLED device 50, thus providing a complete compensation solution. These changes can be applied by the controller to correct the light output to the nominal luminance value desired. By controlling the signal applied to the OLED device, an OLED device with a constant luminance output and increased lifetime at a given luminance is achieved. Because this method provides a correction for each OLED device in a display, it will compensate for spatial variations in the characteristics of the plurality of OLED drive circuits.

In a preferred embodiment, the invention is employed in a display that includes Organic Light Emitting Diodes (OLEDs), which are composed, of small molecule or polymeric OLEDs as disclosed in but not limited to U.S. Pat. No. 4,769,292, by Tang et al., and U.S. Pat. No. 5,061,569, by VanSlyke et al. Many combinations and variations of organic light emitting displays can be used to fabricate such a display.

Figure 6:
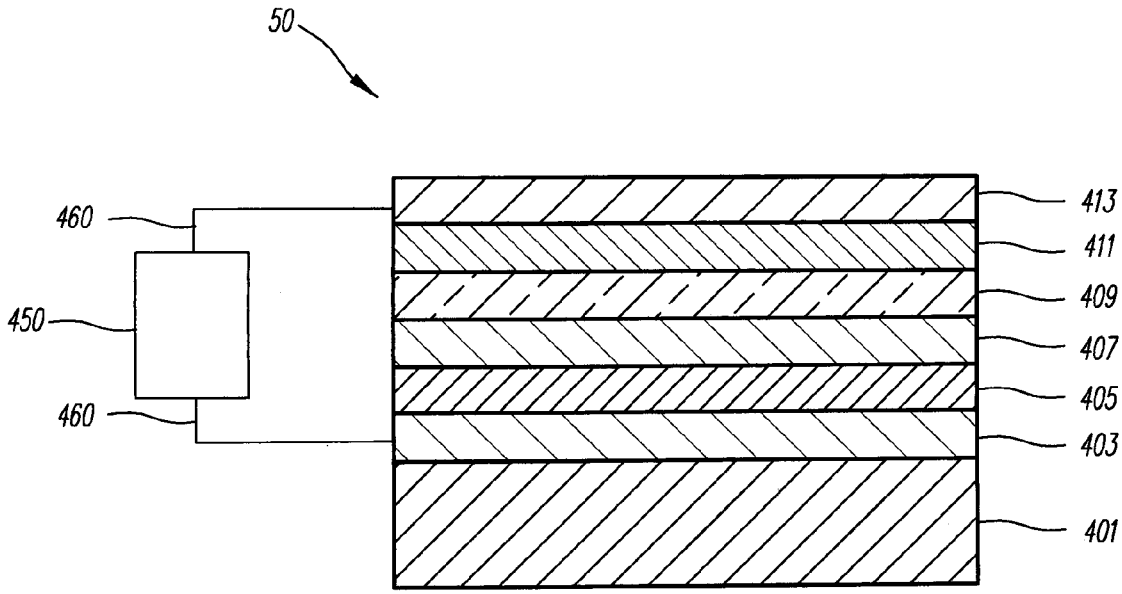
FIG. 6 is a cross-sectional diagram representing the structure of a prior art OLED device useful with the present invention.

There are numerous configurations of the organic layers in an OLED device wherein the present invention can be successfully practiced. A typical prior art structure is OLED device 50 shown in FIG. 6 and is comprised of a substrate 401, an anode 403, a hole-injecting layer 405, a hole-transporting layer 407, a light-emitting layer 409, an electron-transporting layer 411, and a cathode 413. These layers are described in detail below. Note that the substrate can alternatively be located adjacent to the cathode, or the substrate can actually constitute the anode or cathode. The organic layers between the anode and cathode are conveniently referred to as the organic EL element. The total combined thickness of the organic layers is preferably less than 500 nm. The device can be top-emitting (light is emitted through cathode 413) or bottom-emitting (light is emitted through anode 403 and substrate 401).

The anode and cathode of the OLED are connected to a voltage/current source 450 through electrical conductors 460. The OLED is operated by applying a potential between the anode and cathode such that the anode is at a more positive potential than the cathode. Holes are injected into the organic EL element from the anode and electrons are injected into the organic EL element at the cathode. Enhanced display stability can sometimes be achieved when the OLED is operated in an AC mode where, for some time period in the cycle, the potential bias is reversed and no current flows. An example of an AC-driven OLED is described in U.S. Pat. No. 5,552,678.

The OLED display of this invention is typically provided over a supporting substrate where either the cathode or anode can be in contact with the substrate. The electrode in contact with the substrate is conveniently referred to as the bottom electrode. Conventionally, the bottom electrode is the anode, but this invention is not limited to that configuration. The substrate can either be transmissive or opaque. In the case wherein the substrate is transmissive but the device is top-emitting, a reflective or light absorbing layer can be used to reflect the light or to absorb the light, thereby improving the contrast of the display. Substrates can include, but are not limited to, glass, plastic, semiconductor materials, silicon, ceramics, and circuit board materials. This invention is particularly useful when the substrate includes an amorphous silicon portion that is used to form the drive circuitry.

When EL emission is viewed through anode 403, the anode should be transparent or substantially transparent to the emission of interest. Common transparent anode materials used in this invention are indium-tin oxide (ITO), indium-zinc oxide (IZO) and tin oxide, but other metal oxides can work including, but not limited to, aluminum- or indium-doped zinc oxide, magnesium-indium oxide, and nickel-tungsten oxide. In addition to these oxides, metal nitrides, such as gallium nitride, and metal selenides, such as zinc selenide, and metal sulfides, such as zinc sulfide, can be used as the anode. For applications where EL emission is viewed only through the cathode electrode, the transmissive characteristics of anode are immaterial and any conductive material can be used, transparent, opaque or reflective. Example conductors for this application include, but are not limited to, gold, iridium, molybdenum, palladium, and platinum. Typical anode materials, transmissive or otherwise, have a work function of 4.1 eV or greater. Desired anode materials are commonly deposited by any suitable way such as evaporation, sputtering, chemical vapor deposition, or electrochemical techniques. Anodes can be patterned using well-known photolithographic processes. Optionally, anodes can be polished prior to application of other layers to reduce surface roughness so as to reduce shorts or enhance reflectivity.

While not always necessary, it is often useful to provide a hole-injecting layer 405 between anode 403 and hole-transporting layer 407. The hole-injecting material can serve to improve the film formation property of subsequent organic layers and to facilitate injection of holes into the hole-transporting layer. Suitable materials for use in the hole-injecting layer include, but are not limited to, porphyrinic compounds as described in U.S. Pat. No. 4,720,432, plasma-deposited fluorocarbon polymers as described in U.S. Pat. No. 6,208,075, and some aromatic amines, for example, m-MTDATA (4,4',4"-tris[(3-methylphenyl)phenylamino]triphenylamine). Alternative hole-injecting materials reportedly useful in organic EL displays are described in EP 0 891 121 A1 and EP 1 029 909 A1.

The hole-transporting layer 407 contains at least one hole-transporting compound such as an aromatic tertiary amine, where the latter is understood to be a compound containing at least one trivalent nitrogen atom that is bonded only to carbon atoms, at least one of which is a member of an aromatic ring. In one form the aromatic tertiary amine can be an arylamine, such as a monoarylamine, diarylamine, triarylamine, or a polymeric arylamine. In U.S. Pat. No. 3,180,730 Klupfel et al. illustrates exemplary monomeric triarylamines. Other suitable triarylamines substituted with one or more vinyl radicals or comprising at least one active hydrogen containing group are disclosed by Brantley et al U.S. Pat. Nos. 3,567,450 and 3,658,520.

A more preferred class of aromatic tertiary amines are those which include at least two aromatic tertiary amine moieties as described in U.S. Pat. Nos. 4,720,432 and 5,061,569. The hole-transporting layer can be formed of a single or a mixture of aromatic tertiary amine compounds. Illustrative of useful aromatic tertiary amines are the following:

1,1-Bis(4-di-p-tolylaminophenyl)cyclohexane
1,1-Bis(4-di-p-tolylaminophenyl)-4-phenylcyclohexane
4,4'-Bis(diphenylamino)quadriphenyl
Bis(4-dimethylamino-2-methylphenyl)-phenylmethane
N,N,N-Tri(p-tolyl)amine
4-(di-p-tolylamino)-4'-[4(di-p-tolylamino)-styryl]stilbene
N,N,N',N'-Tetra-p-tolyl-4-4'-diaminobiphenyl
N,N,N',N'-Tetraphenyl-4,4'-diaminobiphenyl
N,N,N',N'-tetra-1-naphthyl-4,4'-diaminobiphenyl
N,N,N',N'-tetra-2-naphthyl-4,4'-diaminobiphenyl
N-Phenylcarbazole
4,4'-Bis[N-(1-naphthyl)-N-phenylamino]biphenyl
4,4'-Bis[N-(1-naphthyl)-N-(2-naphthyl)amino]biphenyl
4,4"-Bis[N-(1-naphthyl)-N-phenylamino]p-terphenyl
4,4'-Bis[N-(2-naphthyl)-N-phenylamino]biphenyl
4,4'-Bis[N-(3-acenaphthenyl)-N-phenylamino]biphenyl
1,5-Bis[N-(1-naphthyl)-N-phenylamino]naphthalene
4,4'-Bis[N-(9-anthryl)-N-phenylamino]biphenyl
4,4"-Bis[N-(1-anthryl)-N-phenylamino]-p-terphenyl
4,4'-Bis[N-(2-phenanthryl)-N-phenylamino]biphenyl
4,4'-Bis[N-(8-fluoranthenyl)-N-phenylamino]biphenyl
4,4'-Bis[N-(2-pyrenyl)-N-phenylamino]biphenyl
4,4'-Bis[N-(2-naphthacenyl)-N-phenylamino]biphenyl
4,4'-Bis[N-(2-perylenyl)-N-phenylamino]biphenyl
4,4'-Bis[N-(1-coronenyl)-N-phenylamino]biphenyl
2,6-Bis(di-p-tolylamino)naphthalene
2,6-Bis[di-(1-naphthyl)amino]naphthalene
2,6-Bis[N-(1-naphthyl)-N-(2-naphthyl)amino]naphthalene
N,N,N',N'-Tetra(2-naphthyl)-4,4"-diamino-p-terphenyl
4,4'-Bis{N-phenyl-N-[4-(1-naphthyl)-phenyl] amino}biphenyl
4,4'-Bis[N-phenyl-N-(2-pyrenyl)amino]biphenyl
2,6-Bis[N,N-di(2-naphthyl)amine]fluorene
1,5-Bis[N-(1-naphthyl)-N-phenylamino]naphthalene
4,4',4"-tris[(3-methylphenyl)phenylamino]triphenylamine Another class of useful hole-transporting materials includes polycyclic aromatic compounds as described in EP 1 009 041. Tertiary aromatic amines with more than two amine groups can be used including oligomeric materials. In addition, polymeric hole-transporting materials can be used such as poly(N-vinylcarbazole) (PVK), polythiophenes, polypyrrole, polyaniline, and copolymers such as poly(3,4-ethylenedioxythiophene)/poly(4-styrenesulfonate) also called PEDOT/PSS.

As more fully described in U.S. Pat. Nos. 4,769,292 and 5,935,721, the light-emitting layer (LEL) 409 of the organic EL element includes a luminescent or fluorescent material where electroluminescence is produced as a result of electron-hole pair recombination in this region. The light-emitting layer can be comprised of a single material, but more commonly consists of a host material doped with a guest compound or compounds where light emission comes primarily from the dopant and can be of any color. The host materials in the light-emitting layer can be an electron-transporting material, as defined below, a hole-transporting material, as defined above, or another material or combination of materials that support hole-electron recombination. The dopant is usually chosen from highly fluorescent dyes, but phosphorescent compounds, e.g., transition metal complexes as described in WO 98/55561, WO 00/18851, WO 00/57676, and WO 00/70655 are also useful. Dopants are typically coated as 0.01 to 10% by weight into the host material. Polymeric materials such as polyfluorenes and polyvinylarylenes (e.g., poly (p-phenylenevinylene), PPV) can also be used as the host material. In this case, small molecule dopants can be molecularly dispersed into the polymeric host, or the dopant can be added by copolymerizing a minor constituent into the host polymer.

An important relationship for choosing a dye as a dopant is a comparison of the bandgap potential which is defined as the energy difference between the highest occupied molecular orbital and the lowest unoccupied molecular orbital of the molecule. For efficient energy transfer from the host to the dopant molecule, a necessary condition is that the band gap of the dopant is smaller than that of the host material. For phosphorescent emitters it is also important that the triplet energy level of the host be high enough to enable energy transfer from host to dopant.

Host and emitting molecules known to be of use include, but are not limited to, those disclosed in U.S. Pat. Nos. 4,768,292; 5,141,671; 5,150,006; 5,151,629; 5,405,709; 5,484,922; 5,593,788; 5,645,948; 5,683,823; 5,755,999; 5,928,802; 5,935,720; 5,935,721; and 6,020,078.

Metal complexes of 8-hydroxyquinoline (oxine) and similar derivatives constitute one class of useful host compounds capable of supporting electroluminescence. Illustrative of useful chelated oxinoid compounds are the following:

CO-1: Aluminum trisoxine [alias, tris(8-quinolinolato) aluminum(III)]

CO-2: Magnesium bisoxine [alias, bis(8-quinolinolato) magnesium(II)]

CO-3: Bis[benzo{f}-8-quinolinolato]zinc (II)

CO-4: Bis(2-methyl-8-quinolinolato)aluminum(III)-μ-oxo-bis(2-methyl-8-quinolinolato)aluminum(III)

CO-5: Indium trisoxine [alias, tris(8-quinolinolato)indium]

CO-6: Aluminum tris(5-methyloxine)[alias, tris(5-methyl-8-quinolinolato) aluminum(III)]

CO-7: Lithium oxine [alias, (8-quinolinolato)lithium(I)]

CO-8: Gallium oxine [alias, tris(8-quinolinolato) gallium (III)]

CO-9: Zirconium oxine [alias, tetra(8-quinolinolato) zirconium(IV)]

Other classes of useful host materials include, but are not limited to: derivatives of anthracene, such as 9,10-di-(2-naphthyl) anthracene and derivatives thereof as described in U.S. Pat. No. 5,935,721, distyrylarylene derivatives as described in U.S. Pat. No. 5,121,029, and benzazole derivatives, for example, 2,2',2"-(1,3,5-phenylene)tris[1-phenyl-1H-benzimidazole]. Carbazole derivatives are particularly useful hosts for phosphorescent emitters.

Useful fluorescent dopants include, but are not limited to, derivatives of anthracene, tetracene, xanthene, perylene, rubrene, coumarin, rhodamine, quinacridone, dicyanomethylenepyran compounds, thiopyran compounds, polymethine compounds, pyrilium and thiapyrilium compounds, fluorene derivatives, periflanthene derivatives, indenoperylene derivatives, bis(azinyl)amine boron compounds, bis(azinyl) methane compounds, and carbostyryl compounds.

Preferred thin film-forming materials for use in forming the electron-transporting layer 411 of the organic EL elements of this invention are metal chelated oxinoid compounds, including chelates of oxine itself (also commonly referred to as 8-quinolinol or 8-hydroxyquinoline). Such compounds help to inject and transport electrons, exhibit high levels of performance, and are readily fabricated in the form of thin films. Exemplary oxinoid compounds were listed above.

Other electron-transporting materials include various butadiene derivatives are disclosed in U.S. Pat. No. 4,356,429. Various heterocyclic optical brighteners are described in U.S. Pat. No. 4,539,507. Benzazoles and triazines are also useful electron-transporting materials.

When light emission is viewed solely through the anode, the cathode 413 used in this invention can be comprised of nearly any conductive material. Desirable materials have good film-forming properties to ensure good contact with the underlying organic layer, promote electron injection at low voltage, and have good stability. Useful cathode materials often contain a low work function metal (<4.0 eV) or metal alloy. One preferred cathode material is comprised of a Mg:Ag alloy wherein the percentage of silver is in the range of 1 to 20%, as described in U.S. Pat. No. 4,885,221. Another suitable class of cathode materials includes bilayers comprising a thin electron-injection layer (EIL) in contact with the organic layer (e.g., ETL), which is capped with a thicker layer of a conductive metal. Here, the EIL preferably includes a low work function metal or metal salt, and if so, the thicker capping layer does not need to have a low work function. One such cathode is comprised of a thin layer of LiF followed by a thicker layer of Al as described in U.S. Pat. No. 5,677,572. Other useful cathode material sets include, but are not limited to, those disclosed in U.S. Pat. Nos. 5,059,861; 5,059,862; and 6,140,763.

When light emission is viewed through the cathode, the cathode must be transparent or nearly transparent. For such applications, metals must be thin or one must use transparent conductive oxides, or a combination of these materials. Optically transparent cathodes have been described in more detail in U.S. Pat. No. 4,885,211, U.S. Pat. No. 5,247,190; JP 3,234,963; U.S. Pat. No. 5,703,436; U.S. Pat. No. 5,608,287; U.S. Pat. No. 5,837,391; U.S. Pat. No. 5,677,572; U.S. Pat. No. 5,776,622; U.S. Pat. No. 5,776,623; U.S. Pat. No. 5,714,838; U.S. Pat. No. 5,969,474; U.S. Pat. No. 5,739,545; U.S. Pat. No. 5,981,306, U.S. Pat. No. 6,137,223, U.S. Pat. No. 6,140,763, U.S. Pat. No. 6,172,459; EP 1 076 368; U.S. Pat. No. 6,278,236; and U.S. Pat. No. 6,284,393. Evaporation, sputtering, or chemical vapor deposition typically deposits cathode materials. When needed, patterning can be achieved through many well known methods including, but not limited to, through-mask deposition and integral shadow masking. U.S. Pat. No. 5,276,380 and EP 0 732 868, disclose laser ablation, and selective chemical vapor deposition.

In some instances, layers 409 and 411 can optionally be collapsed into a single layer that serves the function of supporting both light emission and electron transportation. It also known in the art that light-emitting dopants can be added to the hole-transporting layer, which can serve as a host. Multiple dopants can be added to one or more layers in order to create a white-emitting OLED, for example, by combining blue- and yellow-emitting materials, cyan- and red-emitting materials, or red-, green-, and blue-emitting materials. White-emitting displays are described, for example, in EP 1 187 235, U.S 2002/0025419, EP 1 182 244, U.S. Pat. No. 5,683,823, U.S. Pat. No. 5,503,910, U.S. Pat. No. 5,405,709, and U.S. Pat. No. 5,283,182.

Additional layers such as electron- or hole-blocking layers as taught in the art can be employed in displays of this invention. Hole-blocking layers are commonly used to improve efficiency of phosphorescent emitter displays, for example, as in U.S 2002/0015859.

This invention can be used in so-called stacked display architecture, for example, as taught in U.S. Pat. No. 5,703,436 and U.S. Pat. No. 6,337,492.

The organic materials mentioned above are suitably deposited through a vapor-phase method such as sublimation, but can be deposited from a fluid, for example, from a solvent with an optional binder to improve film formation. If the material is a polymer, solvent deposition is useful but other methods can be used, such as sputtering or thermal transfer from a donor sheet. The material to be deposited by sublimation can be vaporized from a sublimator "boat" often comprised of a tantalum material, e.g., as described in U.S. Pat. No. 6,237,529, or can be first coated onto a donor sheet and then sublimed in closer proximity to the substrate. Layers with a mixture of materials can utilize separate sublimator boats or the materials can be pre-mixed and coated from a single boat or donor sheet. Patterned deposition can be achieved using shadow masks; integral shadow masks (U.S. Pat. No. 5,294,870), spatially-defined thermal dye transfer from a donor sheet (U.S. Pat. Nos. 5,688,551, 5,851,709 and 6,066,357) and inkjet methods (U.S. Pat. No. 6,066,357).

Most OLED displays are sensitive to moisture or oxygen, or both, so they are commonly sealed in an inert atmosphere such as nitrogen or argon, along with a desiccant such as alumina, bauxite, calcium sulfate, clays, silica gel, zeolites, alkaline metal oxides, alkaline earth metal oxides, sulfates, or metal halides and perchlorates. Methods for encapsulation and desiccation include, but are not limited to, those described in U.S. Pat. No. 6,226,890. In addition, barrier layers such as SiOx, Teflon, and alternating inorganic/polymeric layers are known in the art for encapsulation.

OLED displays of this invention can employ various well-known optical effects in order to enhance its properties if desired. This includes selecting layer thicknesses to yield improved light transmission, providing dielectric mirror structures, replacing reflective electrodes with light-absorbing electrodes, providing anti-glare or anti-reflection coatings over the display, providing a polarizing medium over the display, or providing colored, neutral density, or color conversion filters over the display. Filters, polarizers, and anti-glare or anti-reflection coatings can be specifically provided over the cover or an electrode protection layer beneath the cover.

The invention has been described in detail with particular reference to certain preferred embodiments thereof, but it will be understood that variations and modifications can be effected within the spirit and scope of the invention.

PARTS LIST

10 OLED display
20 select line
30 readout line
35 data line
40 multiplexer
45 readout line
50 pixel, or OLED device
60 OLED drive circuit
70 drive transistor
75 capacitor
80 readout transistor
85 data in
90 select transistor
95 control line
110 first switch
120 second switch
130 switch block
140 first voltage source
150 second voltage source
155 digital-to-analog converter
160 current source
165 current sink
170 voltage measurement circuit
180 low-pass filter
185 analog-to-digital converter
190 processor
195 memory
210 $\Delta V_{th}$
220 $\Delta V_{OLED}$
310 step
315 step
320 step
325 step
330 decision step
335 decision step
340 step
345 step
350 step
355 decision step
360 decision step
370 step
401 substrate
403 anode
405 hole injecting layer
407 hole transporting layer
409 light emitting layer
411 electron-transporting layer
413 cathode
450 voltage/current source
460 electrical conductors

The invention claimed is:

1. A method of compensating for changes in characteristics of an OLED drive circuit, comprising:

a. providing a drive transistor with a first electrode, a second electrode, and a gate electrode;

b. providing a first voltage source and a first switch for selectively connecting the first voltage source to the first electrode of the drive transistor;

c. providing an OLED device connected to the second electrode of the drive transistor, and a second voltage source and a second switch for selectively connecting the OLED device to the second voltage source;

d. connecting the first electrode of a readout transistor to the second electrode of the drive transistor;

e. providing a current source and a third switch for selectively connecting the current source to the second electrode of the readout transistor;

f. providing a current sink and a fourth switch for selectively connecting the current sink to the second electrode of the readout transistor;

g. providing a test voltage to the gate electrode of the drive transistor and providing a voltage measurement circuit connected to the second electrode of the readout transistor;

h. closing the first and fourth switches, and opening the second and third switches and using the voltage measurement circuit to measure the voltage at the second electrode of the readout transistor to provide a first signal representative of characteristics of the drive transistor;

i. opening the first and fourth switches, and closing the second and third switches and using the voltage measurement circuit to measure the voltage at the second electrode of the readout transistor to provide a second signal representative of characteristics of the OLED device; and j. using the first and second signals to compensate for changes in characteristics of the OLED drive circuit.

2. The method of claim 1, wherein step j includes storing the first and second signals during separate test measurements, and comparing changes in corresponding stored signals to compensate for changes in characteristics of the OLED drive circuit.

3. The method of claim 1, wherein the voltage measurement circuit includes an analog-to-digital converter.

4. The method of claim 3, wherein the voltage measurement circuit further includes a low-pass filter.

5. The method of claim 1, further including providing a plurality of OLED drive circuits incorporated in a display, and wherein steps h and i are performed for a predetermined number of such OLED drive circuits during which the predetermined number of drive circuits are driven simultaneously.

6. The method of claim 5, wherein step j includes comparing the measured first and second signals for each of the plurality of OLED drive circuits to first and second target signals, to compensate for spatial variations in characteristics of the OLED drive circuits.

7. The method of claim 5, wherein the OLED device circuits are arranged in rows and columns, and further including a plurality of row select lines connected to the gate electrodes of respective select transistors and a plurality of readout lines connected to the second electrodes of respective readout transistors.

8. The method of claim 7, further including using a multiplexer connected to the plurality of readout lines for sequentially reading out the first and second signals for the predetermined number of OLED drive circuits.

9. The method of claim 1, further including a select transistor connected to the gate electrode of the drive transistor, and wherein the gate electrode of the select transistor is connected to the gate electrode of the readout transistor.

* * * * *